US005517967A

United States Patent [19]

Nakayama

[11] Patent Number: 5,517,967

[45] Date of Patent: May 21, 1996

[54] SAFETY DEVICE FOR A THROTTLE OF AN INTERNAL COMBUSTION ENGINE

[75] Inventor: Yoshiki Nakayama, Akishima, Japan

[73] Assignee: Kioritz Corporation, Tokyo, Japan

[21] Appl. No.: 426,011

[22] Filed: Apr. 20, 1995

[30] Foreign Application Priority Data

Apr. 25, 1994 [JP] Japan ..... 6-086608

[51] Int. Cl.[6] ..... F02D 7/00

[52] U.S. Cl. ..... 123/398

[58] Field of Search ..... 123/398, 397, 123/179.18, 179.16

[56] References Cited

U.S. PATENT DOCUMENTS

| | | | |
|---|---|---|---|
| 4,302,880 | 12/1981 | Elfing et al. | 123/398 |
| 4,570,593 | 2/1986 | Take et al. | 123/398 |
| 4,672,929 | 6/1987 | Wissmann et al. | 123/398 |
| 4,761,939 | 8/1988 | Zerrer | 561/12.7 |
| 5,215,049 | 6/1993 | Wolf | 123/179.18 |

*Primary Examiner*—Raymond A. Nelli

*Attorney, Agent, or Firm*—Armstrong, Westerman, Hattori, McLeland & Naughton

[57] ABSTRACT

A safety device for a throttle of an internal combustion engine comprises a throttle lever for controlling an opening of a throttle valve of the internal combustion engine, a throttle lever control means for selectively locking and unlocking operation of the throttle lever, a throttle lever control cancellation means for cancelling the throttle lever control means from controlling the throttle lever and an internal combustion engine operation control means, responsive to displacement of said throttle lever control cancellation means, for selectively operating and stopping the operation of said internal combustion engine.

4 Claims, 2 Drawing Sheets

SAFETY DEVICE FOR A THROTTLE OF AN INTERNAL COMBUSTION ENGINE

BACKGROUND OF THE INVENTION

The present invention relates to a safety device for a throttle of an internal combustion engine and, more particularly, pertains to a new and improved safety device for a throttle of an internal combustion engine wherein the engine, such as a small two-cycle gasoline engine, includes an electric ignition device especially adapted for portable working machines, such as a hedge trimmer, an edger and the like.

Generally, a throttle of such kind for controlling an opening of a throttle valve of the internal combustion engine, a power source of the portable operation machines, comprises a throttle trigger (throttle lever) mounted on a handle or an operation rod, wherein an operator grips, one-handed, a hand grip portion of the handle, or the operation rod, while operating the throttle trigger with fingers of the gripping hand, so that the opening of the throttle valve can be adjusted to control engine power.

In such a throttle of the internal combustion engine, adapted for hedge trimmer and the like, when the operator releases the throttle lever to have the engine idle, a centrifugal clutch is automatically disconnected and operation of blade member is suspended. However, in case where unforeseen accidents arise, such as malfunction of the throttle in mowing operation and the like due to intrusion of grass or dust into the internal combustion engine, the engine speed cannot be decreased, even though the throttle lever has been released by the operator, and the blade member continues to rotate, which, in turn, could cause an irreparable accident. Otherwise, if some portions of the operator's body inadvertently contact with the throttle lever, the engine speed would quickly increase and cause a dangerous situation.

Assignee of the present invention has proposed a throttle device for an internal combustion engine, as disclosed in Japanese Unexamined Patent Publication No. Hei 2-163427, wherein a lock of the throttle lever is released only when the operator grips a safety lock lever, attached to the handle, as well as the throttle lever.

Other references, such as Japanese Examined Utility Model Publication No. Sho 56-32574, have suggested that a safety mechanism for an operation device of an internal combustion engine, adapted for a portable trimmer wherein the mechanism includes a stop switch, for automatically bringing the engine to a stop, in a manner that a movable contact, attached to the throttle lever, gets in contact with a fixed contact, attached to a body, when the operator releases the throttle lever, in operation of the trimmer.

In the former prior art, as described above, because the throttle lever can be mechanically looked, interconnecting with the safety lock lever, quick increase of the engine speed, due to inadvertent contact of some portions of the operator's body with the throttle lever and the like, can be prevented and dangerous situation can be avoided. However, this kind of prior art has a safety problem in that, because such a device cannot completely stop the operation of the engine, in case of the foregoing unforeseen malfunction of the throttle, the engine speed cannot be decreased, even though the throttle lever has been released by the operator, and the blade member continues to rotate, which, in turn, would cause an irreparable accident.

On the other hand, in the foregoing latter prior art, because the safety mechanism is constructed as electrically interconnecting the terminals, this kind of prior art has a reliability problem, as a safety device, in that such troubles, as a breaking of wire or a short circuit, could cause unexpected accident.

SUMMARY OF THE INVENTION

In view of the foregoing disadvantages, inherent of the known type of prior art, the present invention solves the above problems. Thus, it is an object of the present invention to provide a safety device, for a throttle of an internal combustion engine, wherein the throttle lever, if inadvertently contacted, can be securely locked.

Another object of the present invention is to provide a safety device, for a throttle of an internal combustion engine, wherein the operation of the internal combustion engine can be securely suspended, even in the case of occurrence of unforeseen malfunction thereof.

Still another object of the present invention is to provide a safety device, for a throttle of an internal combustion engine, wherein operativity and reliability can be improved.

To attain the foregoing, a safety device, for a throttle of an internal combustion engine, according to one preferred mode of the present invention, comprises a throttle lever for controlling an opening of a throttle valve of the internal combustion engine; a throttle lever control means for locking or unlocking operation of the throttle lever; a throttle lever control cancellation means for cancelling the throttle lever control means from controlling the throttle lever; and an internal combustion engine operation control means, responsive to displacement of the throttle lever control cancellation means, for selectively operating or stopping the operation of the internal combustion engine.

It is preferable, in the more specific mode of the foregoing, that the internal combustion engine operation control means comprise a normally closed contact switch, operated by the foregoing throttle lever control means.

Another preferred mode of the safety device for a throttle of an internal combustion engine, according to the present invention, comprises a throttle lever for controlling an opening of a throttle valve of the internal combustion engine; a throttle lever control means for locking or unlocking operation of the throttle lever; a throttle lever control cancellation means for cancelling the throttle lever control means from controlling the throttle lever; and an internal combustion engine operation control means for selectively operating or stopping the operation of the internal combustion engine.

It is preferable, in the more specific mode of the foregoing, that the internal combustion engine operation control means be mounted on a hand grip portion of an operation rod wherein operation of the internal combustion engine is stopped when the gripping pressure by the operator is less than predetermined pressure.

As constructed as described above, according to the safety device for a throttle of an internal combustion engine of the present invention, when an operator grips the throttle lever control cancellation means with a palm of his hand, the internal combustion engine operation control means, through the throttle lever control means, operates so that the internal combustion engine is ready to operate. That is, the internal combustion engine is enabled to be started and the throttle lever is released from the restricted condition to be freely operable.

While, when the operator releases the throttle lever, the throttle lever control means is engaged with the throttle lever, so that unintentional operation of the throttle lever can be restricted. In this condition, the internal combustion engine operation control means is released and the internal combustion engine is stopped.

Accordingly, the internal combustion engine cannot be operated unless the operator properly grips the hand grip portion of the operation rod.

BRIEF DESCRIPTION OF THE DRAWINGS

The instant invention will be more fully described and better understood from the following description, taken with the appended drawings, in which.

DETAILED DESCRIPTION OF THE PREFERRED EMBODIMENT

Preferred embodiment of the present invention will now be described, in detail, with reference to the accompanying drawings.

Figure 1:
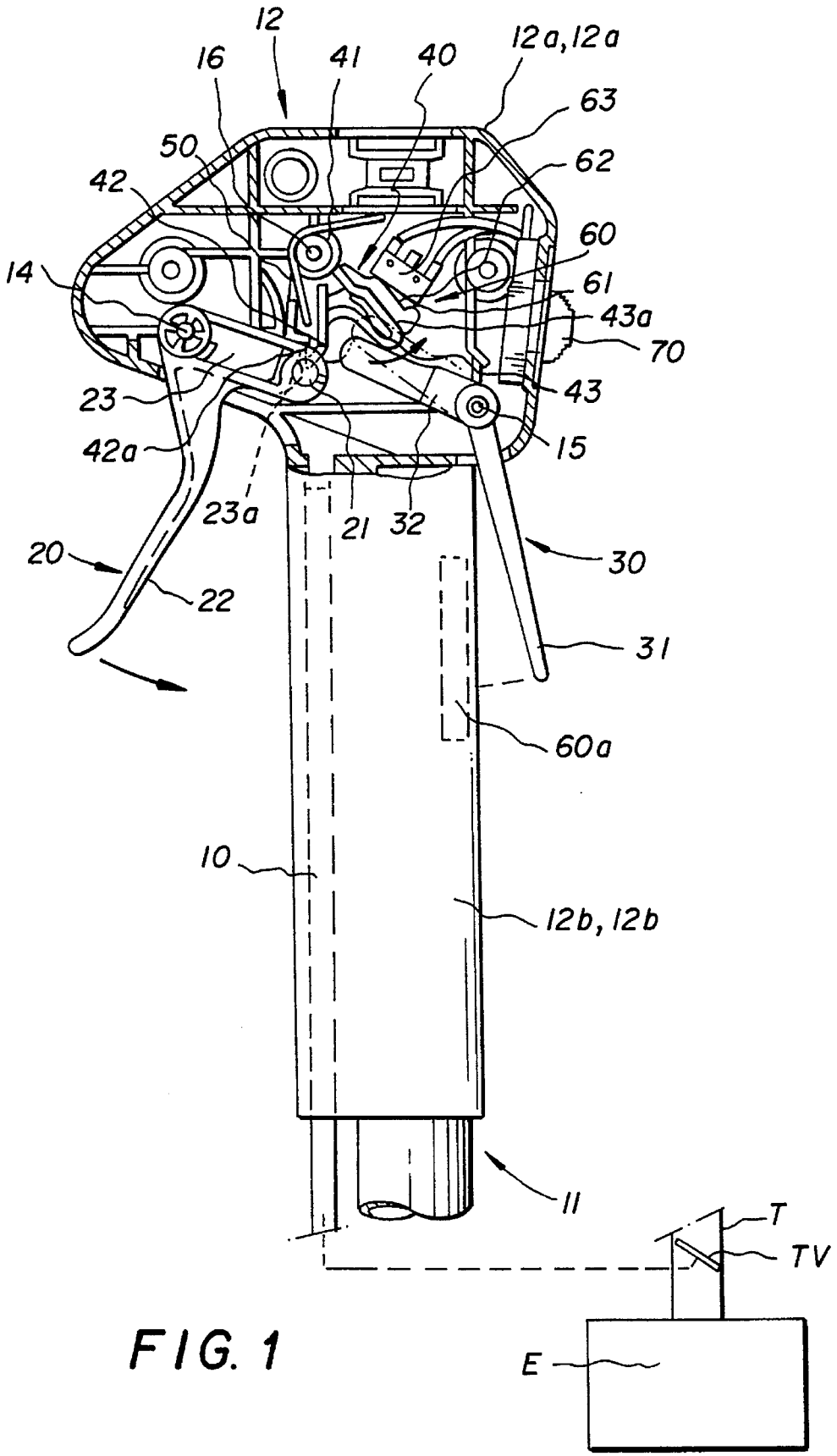
FIG. 1 is a fragmentary longitudinal sectional view of one embodiment of the safety device for a throttle of an internal combustion engine according to the present invention.

As shown in FIG. 1, a hollow case 12, having a hand grip portion 12*b* integrally formed therewith, is mounted on a tip portion of a tubular operation rod 11 of a hedge trimmer, and the like (not shown). The case 12 is composed of two longitudinally symmetrical case portions 12*a*, 12*a* and hand grip portions 12*b*, 12*b*, interconnected to form the case 12. A throttle lever 20 is pivotally connected to a pivotal shaft 14, fixed to the case 12, at one side of the case 12, wherein an internal end of the throttle lever 20 is connected to a tip of a wire 10, interconnecting the throttle lever 20 and throttle valve TV of a carburetor of the internal combustion engine E, such as a small two-cycle gasoline engine. The throttle lever 20 comprises a bow shaped handle portion 22, elongated outwardly from the case 12, for an operator to handle with his fingers, and a swinging portion 23, a tip of which is connected to the wire 10, wherein the handle portion 22 and the swinging portion 23 are integrally formed with a predetermined angle.

On the opposite side of the mount position of the throttle lever 20, inside the case 12, a throttle lever control cancellation means 30 (hereinafter referred to as "throttle lock lever") is pivotally mounted on a pivotal shaft 15, fixed to the case 12, wherein the throttle lock lever 30 can cancel the lock condition of the throttle lever 20 by a throttle lever control means 40 (hereinafter referred to as "throttle latch"). The throttle lock lever 30 comprises a flat board handle portion 31, elongated outwardly from the case 12, for an operator to handle with his palm, and an operating portion 32 for rotating the throttle latch 40, while abutting therewith, wherein the handle portion 31 and the operating portion 32 are integrally formed with a predetermined angle.

Between the throttle lever 20 and the throttle lock lever 30 is mounted the throttle latch 40, which is rotated by the operation of the throttle lock lever 30, for locking or unlocking the throttle lever 20, and serve as a throttle lever control means. The throttle latch 40 comprises a tubular pivot portion 41, at a central portion thereof, a lock portion 42 and a swinging portion 43, extending from the pivot portion 41, with a predetermined angle therebetween, wherein the pivot portion 41 is pivotally mounted on a pivotal shaft 16, fixed to the case 12. The lock portion 42 includes a rectangular engaging recess portion 42*a* at an external tip portion thereof, with which a rectangular engaging projecting portion 23*a* (FIG. 3), formed on a tip of a back surface of the swinging portion 23 of the throttle lever 20 (in a lock condition as shown in solid lines of FIG. 1 and FIG. 2 ), is engaged.

Figure 2:
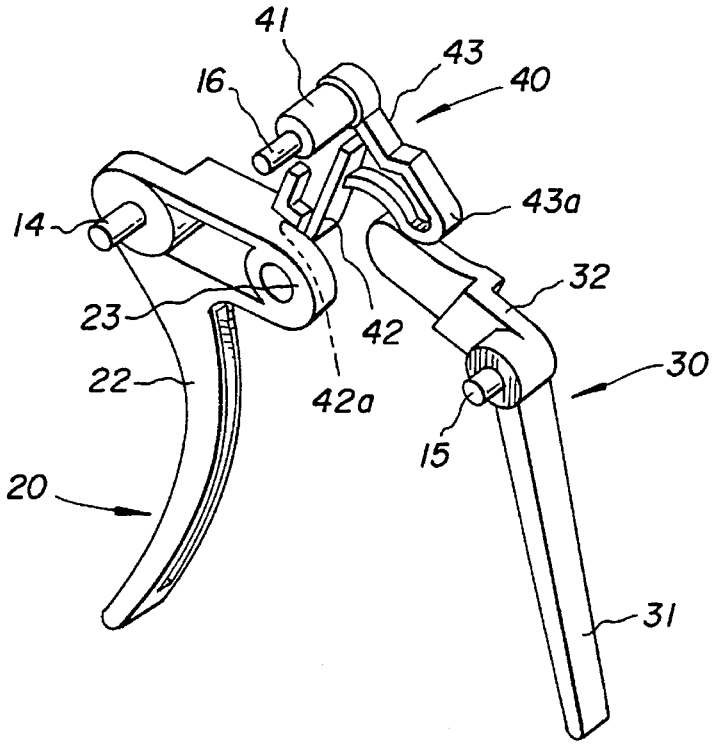
FIG. 2 is a partly exploded perspective view of the safety device for a throttle of an internal combustion engine wherein some elements, such as a case and torsion coil spring, are removed from the same as shown in FIG. 1, to better show a lock condition of the throttle lever.
Figure 3:
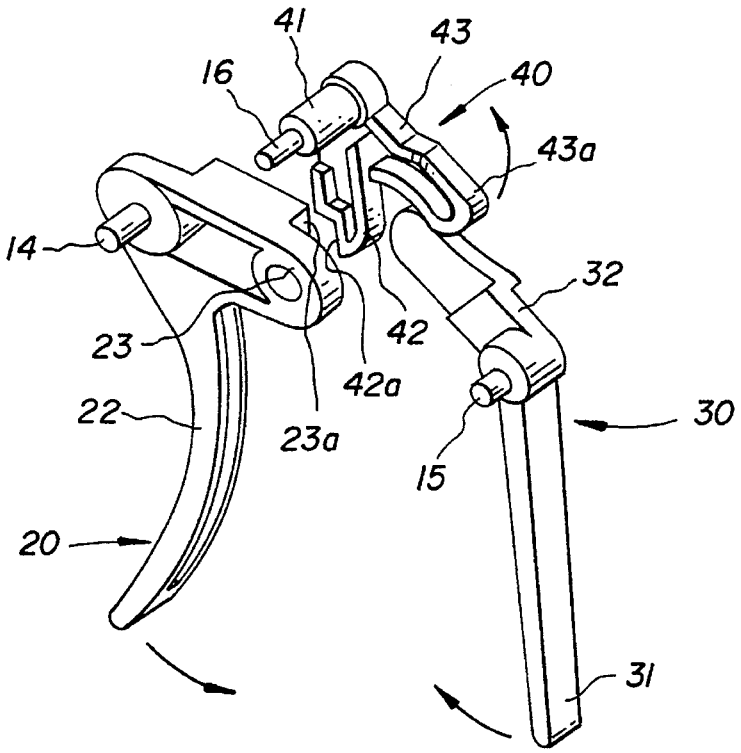
FIG. 3 is a partly exploded perspective view of the safety device for a throttle of an internal combustion engine of FIG. 2 in a lock cancellation condition.

Around a periphery of the pivot portion 41 is mounted a torsion coil spring 50 for urging the throttle latch 40 toward the throttle lever 20 in a clockwise direction, as viewed in FIG. 1, wherein the engaging recess portion 42*a* of the throttle latch 40 is urged to an engagement position, being engaged with the engaging projecting portion 23*a* of the throttle lever 20, in a lock condition, as shown in solid lines of FIG. 1 and FIG. 2.

As shown in FIG. 1, an internal combustion engine operation control means 60 (hereinafter referred to as "micro switch") is mounted adjacent to a contact portion 43*a*, formed at the external surface of the swinging portion 43 of the throttle latch 40, wherein the micro switch 60, made up of such as normally closed contact switch, is connected to an electric ignition device of an internal combustion engine E. The micro switch 60 comprises a switch body 63, having an exposed external end of a movable contact 62, and a movable contact abutting strip 61, swingably mounted on one end of the switch body 63, wherein, when the throttle latch 40 rotates about the pivotal shaft 16 in a counterclockwise direction, as viewed in FIG. 1, the movable contact abutting strip 61 is pressed against the movable contact 62, to an open condition thereof, by the contact portion 43*a* of the swinging portion 43, so that the electric ignition device, of an internal combustion engine E, can be ready to operate. Besides, a manual stop switch (main switch) 70, to be handled by fingers, connected to the electric ignition device, in parallel with the micro switch 60, is mounted on the back end of the case 12.

Next, operation of the safety device for a throttle T of an internal combustion engine E according to one embodiment of the present invention will now be described.

When the main switch 70 is on (contact opened), as shown in solid lines of FIG. 1 and FIG. 2, the engaging recess portion 42*a* of the throttle latch 40 is urged, by the torsion coil spring 50, to an engagement position thereof, being engaged with the engaging projecting portion 23*a* of the throttle lever 20, in a lock condition of the throttle lever 20, so that the handle portion 22 thereof cannot be manipulated. Besides, in this condition, where the movable contact abutting strip 61 of the micro switch 60 is not abutted against the movable contact 62 thereof, the contact of the micro switch 60 is in a closed condition (electricity turned on) and accordingly the electric ignition device cannot be operated.

Then an operator grips the throttle lock lever 30 with a palm of his hand, the throttle latch 40 rotates about the pivotal shaft 16, in a counterclockwise direction as viewed in FIG. 1, so that the movable contact abutting strip 61 pushes the movable contact 62 and the contact of the micro switch 60 is opened. In this condition, because the short circuit of the ignition device is cancelled, not only the internal combustion engine E is enabled to be started, by manipulating a recoil starter, and the like, but the engaging projecting portion 23*a*, of the throttle lever 20, is released from the engaging recess portion 42*a* of the throttle latch 40, thereby cancelling a lock of the throttle lever 20. In this way, the throttle lever 20 can be freely manipulated so that the speed increasing of the internal combustion engine E can be available (see phantom lines of FIG. 1 and FIG. 3).

As will be apparent from the foregoing, because the safety device for a throttle T of an internal combustion engine E, according to the present invention, adopts a double failsafe system, that is, not only the throttle lever 20 cannot be manipulated unless the operator properly grips the throttle lock lever 30, but also the throttle lever 20 cannot be manipulated, when the operator releases his hand from the hand grip portion 12*b* of the operation rod 11, while the operation of the internal combustion engine E is stopped as soon as the operator releases his hand therefrom. The throttle lever 20, if inadvertently contacted by some portions of the operator's body, can be securely locked, thereby preventing the blade member, and the like, from unexpectedly operating.

Further, according to the foregoing embodiment, wherein each member is constructed as shown in FIG. 1, it is noted that one torsion coil spring 50 can provide all the necessary urging force.

Furthermore, the internal combustion engine operation control means is not limited to the micro switch 60, as described in the foregoing illustrated example, but other switches, such as a pressure switch 60*a*, FIG. 1, may be used therefor. Such switch cannot operate the internal combustion engine E unless the pressure switch 60*a* can sense a predetermined pressure imposed on the hand grip portion 12*b* of the operation rod 11 by the operator's grasping power.

As hereinbefore pointed out, according to the present invention, there are obtained an excellent safety device for a throttle of an internal combustion engine, wherein the throttle lever, if inadvertently contacted, can be securely locked. The operation of the internal combustion engine can be securely suspended, even in the case of occurrence of unforeseen malfunction thereof, and operativity and reliability can be improved.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. A safety device for a throttle of an internal combustion engine, comprising:

a throttle lever for controlling an opening of a throttle valve of the internal combustion engine;

a throttle lever control means for locking and unlocking operation of said throttle lever;

a throttle lever control cancellation means for cancelling said throttle lever control means from controlling said throttle lever; and an internal combustion engine operation control means, responsive to displacement of said throttle lever control cancellation means, for selectively operating and stopping the operation of said internal combustion engine.

2. A safety device for a throttle of an internal combustion engine as recited in claim 1 wherein said internal combustion engine operation control means comprise a normally closed contact switch, operated by said throttle lever control means.

3. A safety device for a throttle of an internal combustion engine, comprising:

a throttle lever for controlling an opening of a throttle valve of an internal combustion engine;

a throttle lever control means for locking and unlocking operation of said throttle lever;

a throttle lever control cancellation means for cancelling said throttle lever control means from controlling said throttle lever; and an internal combustion engine operation control means for selectively operating and stopping the operation of said internal combustion engine.

4. A safety device for a throttle of an internal combustion engine as recited in claim 3, further comprises an operation rod, said operation rod having a hand grip portion, wherein said internal combustion engine operation control means is mounted on said hand grip portion, whereby operation of said internal combustion engine is stopped when a pressure imposed thereon is less than a predetermined pressure.

* * * * *